United States Patent [19]

Bogdanov et al.

[11] 3,959,622

[45] May 25, 1976

[54] FLEXIBLE ELECTRIC HEATER ELEMENT

[76] Inventors: Alexei Alexeevich Bogdanov, Prazhskaya ulitsa, 9, korpus 2, kv. 35; Zakhar Izrailevich Fonarev, prospekt Gagarina, 25, kv. 32; Viktor Petrovich Khorkov, prospekt Slavy, 23, kv. 209, all of Leningrad; Adolf Moritsovich Alexandrov, Federativny prospekt, 6, korpus 3, kv. 8, Moscow; Ninel Rafailovna Iosilevich, prospekt Shaumiana, 54, kv. 27, Leningrad; Vyacheslav Vladimirovich Shitov, ulitsa, Vedeneeva, 14, kv. 23; Yakov Shamilievich Darier, ulitsa Inzhenernaya, 37, kv. 11, both of Rybinsk Yaroslavskoi oblasti; Vsevolod Vladimirovich Peller, Michurinskaya ulitsa, 11, kv. 134; Alexandr Sergeevich Kostygov, prospekt Slavy, 30, korpus 1, kv. 217, both of Leningrad, all of U.S.S.R.

[22] Filed: Jan. 3, 1975

[21] Appl. No.: 538,416

[30] Foreign Application Priority Data

Jan. 4, 1974 U.S.S.R. ..... 1984017
June 17, 1974 U.S.S.R. ..... 2034573

[52] U.S. Cl. ..... 219/549; 29/613; 338/214; 338/226

[51] Int. Cl.[2] ..... H05B 3/56

[58] Field of Search ..... 219/528, 549, 538; 174/115, 117 R, 117 F; 338/214, 226, 295; 29/611, 613

[56] References Cited

UNITED STATES PATENTS

| | | | |
|---|---|---|---|
| 1,840,536 | 1/1932 | Shore | 174/117 F X |
| 2,254,068 | 8/1941 | Frank | 174/117 F X |
| 2,822,460 | 2/1958 | Goldstaub | 219/549 X |
| 2,985,860 | 5/1961 | Morey | 219/528 X |
| 3,033,916 | 5/1962 | Scofield | 174/117 R |
| 3,108,154 | 10/1963 | Cound | 174/117 F X |
| 3,209,128 | 9/1965 | Chapman, Jr. | 219/528 |
| 3,214,571 | 10/1965 | Indoe | 219/549 X |
| 3,328,510 | 6/1967 | White | 174/117 R X |
| 3,341,690 | 9/1967 | Commins | 219/528 |
| 3,735,022 | 5/1973 | Estep | 174/117 F |

*Primary Examiner*—C. L. Albritton
*Attorney, Agent, or Firm*—Haseltine, Lake & Waters

[57] ABSTRACT

A flexible electric heater element in the form of a band, comprising heating wires disposed in an electrically insulating base enveloped in a sealed sheathing, the current-carrying wires extending outside the sealed sheathing and disposed along at least one of the narrower sides of the heater element.

7 Claims, 12 Drawing Figures

FLEXIBLE ELECTRIC HEATER ELEMENT

The present invention relates to electrothermics and, more particularly, to flexible, band-like electric heater elements comprising resistance alloys.

Due to their flexibility, electric heater elements of this type are wound around an object to be heated without any structural modifications in the latter and ensure adequate heat transfer and uniform distribution of the heat flux over considerable surfaces. Flexible electric heater elements have found extensive application in heating vessels, containers and chemical reactors in order to provide adequate conditions for processes to be carried out at elevated temperatures; such heater elements are also used for heating or freeze-protection of pipelines and equipment employed in the transfer of hightly viscous or easily frozen substances.

The latter include food and technical oils, lubricants, bitumens, paraffins, low-melting metals, synthetic resins, mastics and pastes, fuel oils, etc.

Flexible electric heater elements are utilized in the chemical, oil refining and food industries, as well as in oil extraction, transport, agriculture, construction, metallurgy and municipal services.

There are known and extensively used flexible band electric heater elements having heating and current-carrying wires disposed in an electrically insulating base which locks said wires in a predetermined position with respect to each other. Such elements are also provided with a sealed sheathing.

Electric heater elements with heating and current-carrying wires are advantageous over those which only have heating wires, as they make it possible to have a greater number of internal wire connections, which, in turn, makes it possible to provide heater elements of different length and heating capacity constructed on the basis of one type of electric heater element. In addition, the presence of two current-carrying wires makes it possible to connect a number of electric heater elements to one another and thus heat pipelines of a considerable length. This helps to reduce the amount of supply cable used, as power is supplied only to one point, which, in turn, reduces the amount of construction, assembly and excavation work, including cable laying, ditch digging and installation of junction boxes.

One of the known electric heater elements comprises a band of a flexible, heat-resistant, electrically insulating material, for example, glass fabric, which performs the function of the dielectric base. Two current-carrying copper wires are secured along the edges of the band. Arranged in between said wires is a zigzag heating wire which is connected to the current-carrying wires at evenly spaced points. The electrically insulating base with the wires mounted thereon is additionally insulated with two layers of glass fabric and is provided with a sealed sheathing to make it waterproof.

Another known flexible electric heater element comprises a band of an elastic, electrically insulating material, which band performs the function of an electrically insulating base. Pressed into said base are two current-carrying wires insulated from each other and from a heating wire by the material of the base. The heating wire is wound in coils around the outer surface of the base and is connected at evenly spaced points to the current-carrying wires. This electric heater element is provided with a sealed sheathing to make it waterproof. In addition to the latter function, the sealed sheathing also serves to provide electric insulation for the heating wire.

There is known still another flexible electric heater element which is a flat band of an electrically insulating, plastic and moisture-resistant material, which band serves both as a sealed sheathing and as an electrically insulating base. Pressed into the base are two current-carrying wires and heating wires insulated by the material of the base.

All the foregoing types of flexible electric heater element have, to a varying extent, one disadvantage in common: their current-carrying wires are arranged in immediate proximity to the heating wires, i.e. directly in the intensive heating zone.

All the foregoing types of flexible electric heater element employ copper wire which is easily oxidized, especially at elevated working temperatures.

The operating principle of the above-mentioned electric heater elements is based upon the release of heat by a conductor produced due to the effective resistance of this conductor as current passes therethrough. The heat thus released is supplied both to an object to be heated and to the electric heater element itself; some portion of the heat is released through the thermally insulating coating of the object being heated to the surrounding medium.

Heating of the current-carrying wires is undesirable because, due to a positive temperature resistance coefficient of these wires, it raises their resistance, which results in a release of heat in the current-carrying wires. The latter, in turn, leads to overheating the current-carrying wires which are then rapidly oxidized and rendered inoperative.

In order to prevent destruction of current-carrying wires as a result of oxidation, attempts have been made to reduce the working temperatures of electric heater elements or make use of protective plate coatings for the copper wire. For example, for electric heater elements operating within a temperature range of 200° to 250°C, use is made of copper current-carrying wires plated with silver or nickel.

Silver plating is expensive due to the cost of silver. On the other hand, nickel plating is an extremely arduous and, consequently, expensive process. At the same time, by using a plating it is hard to ensure a uniform coating over the entire length of the wires; as a result, pinpoint coating defects are possible, which may lead to oxidation.

There is known a flexible electric heater element, wherein the foregoing disadvantages are partly eliminated.

This flexible electric heater element is a band woven from fibrous materials, which band performs the function of an electrically insulating base. In this case there are arranged in two parallel rows heating and current-carrying wires separated by a thermally insulating layer. To make it moisture-resistant, the electric heater element of this type is provided with a sealed sheathing of silicone rubber. The current-carrying wires are outside the zone of intensive heating, being spaced from the heating wires at a distance equal to the thickness of the thermally insulating layer. This reduces somewhat the working temperature of the current-carrying wires.

This flexible electric heater element has proved to be convenient and effective for heating pipelines of large diameters both with the heater element being spiral-wound around the pipeline and being arranged along the pipeline.

Although having a number of advantages over the conventional types of electric heater elements, this latter type has some drawbacks which limit the sphere of its application.

In heating small-diameter pipelines, heating wires sometimes are forced out from the electrically insulating base at places where the heater element bends around coupling flanges of the pipeline; as a result, the heating wires are shorted against the current-carrying wires or the pipeline itself, which renders the electric heater element inoperable and may even lead to a fire.

This is accounted for by the fact that while being arranged in two layers, one above the other, the heating and current-carrying wires are displaced with respect to the neutral axis of the electric heater element.

The current-carrying wires are above the neutral axis, whereas the heating wires are below that axis. AS the heater element is bent, its layers that are above the neutral axis are stretched, whereas the layers below the neutral axis are compressed. The greater the distance of a layer from the neutral axis, the greater the stretching or compression force acting upon it.

If a heater element is wound around a pipeline having a diameter of upwards of 0.5 m, these forces are insignificant due to the great radius of curvature and are compensated by the elasticity of the woven electroinsulating material. If, however, the electric heater element is wound around a small-radius pipeline or is bent at a small curvature radius, these forces may exceed the strength of the electroinsulating material. This reduces the longitudinal rigidity of the heating wires and forces them out of the base and the sealed sheathing.

It should also be pointed out that in view of the foregoing factors, the thickness of the thermally insulating layer which separates the heating and current-carrying wires must not be in excess of 2 to 2.5 mm, which only accounts for an insignificant drop in the working temperature of the current-carrying wires.

These disadvantages reduce the reliability and confine the application of the latter type of flexible heater element to heating large-diameter flangeless pipelines.

Among the disadvantages of this type of flexible electric heater element are the following: when several electric heater elements are connected to make up one circuit, the heating wires of these heater elements are connected in parallel with the common current-carrying wires. If N electric heater elements are connected, there flows through the current-carrying wires of the first electric heater element the total current of all the electric heater elements; through the current-carrying wires of the second element there flows current N - 1; through the current-carrying wires of the third element there flows current N - 2, etc.

With an equal section of the current-carrying wires, some part of them is overloaded, whereas the other part is underloaded. This accounts for overheating, rapid oxidation and failures of current-carrying wires in the former case and wastage of copper in the latter case.

It is an object of the present invention to provide a flexible electric heater element which makes it possible to substantially reduce the working temperature of the current-carrying wires and thus prolong the service life and ensure complete operational safety of the electric heater element. The flexible electric heater element of this invention must also reduce the optimum loads in the current-carrying wires and thus make it possible to economize such a scarce material as copper.

The object of the present invention is attained by providing a flexible electric heater element in the form of a band, comprising heating wires disposed in an electrically insulating base enveloped by a sealed sheathing, and current-carrying wires, wherein the current-carrying wires are arranged, in accordance with the invention, along at least one of the narrower sides of the heater element.

It is expedient that along the narrower sides the sealed sheathing be provided with recesses or projections forming a lock joint with respective recesses and projections of at least one jumper intended for the attachment of the current-carrying wires.

It is also expedient that the sealed sheathing be provided with at least one lug disposed along the narrower side of the element, there being inside said lug a channel for the current-carrying wires.

It is desirable that the lug be shaped as a longitudinally cut cylinder whose symmetry axis coincides with the neutral axis of the heater element, the material of the lug having residual plastic deformation.

In an alternative embodiment of a sheathing made of a material with residual plastic deformation, the lug has an open channel, which makes it possible to lay current-carrying wires of a desired section in said channel with subsequent squeezing of the lug walls to close said channel.

The arrangement of the current-carrying wires in the lug channels of the sealed sheathing or outside that sheathing, when the current-carrying wires are secured with the aid of jumpers, reduces the heat flux from the heating wires to the current-carrying wires and produces a temperature difference in the order of 30° to 35° with respect to the temperature of the heating wires.

A ten-degree reduction in the temperature results in a two-fold reduction in the oxidation rate. This substantially prolongs the service life of the current-carrying wires and, consequently, of the heater element as a whole. The result is a substantial reduction in the production and maintenance costs.

This is due to reduced copper consumption, an expanded sphere of application and an increase in the operational safety of the flexible electric heater element.

Other objects and advantages of the present invention will become more apparent from the following detailed description of preferred embodiments thereof taken in conjunction with the accompanying drawings, wherein.

Figure 1:
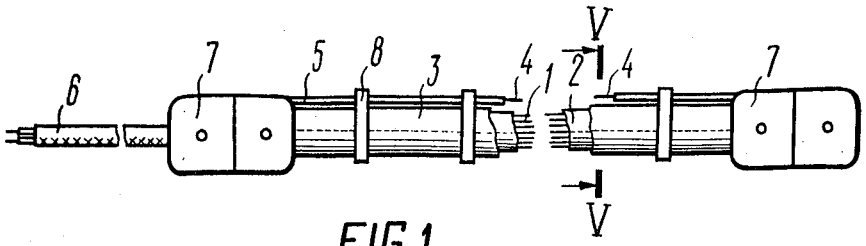
FIG. 1 is a side elevational view of a flexible electric heater element broken in length with one current-carrying wire secured with the aid of jumpers, in accordance with the invention.
Figure 2:
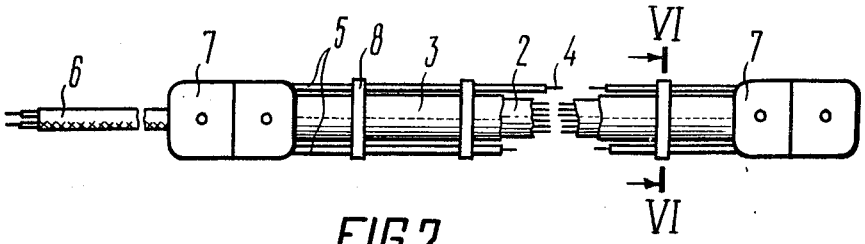
FIG. 2 is a similar view of a flexible electric heater element with two current-carrying wires according to a second embodiment.

Referring now to FIGS. 1 and 2 of the attached drawings, the flexible band-type electric heater element of the present invention comprises resistance-alloy-based heating wires 1 woven, sewn, plaited or pressed into an electrically insulating base 2 of a heat-resistant, electrically insulating material, for example, glass fabric.

The base 2 is provided with a sealed sheathing 3 of a moisture-resistant material, for example, silicone rubber. Current-carrying copper wires 4 provided with a sealed insulating coating 5 extend outside the sealed sheathing 3 of the electrically insulating base 2 and are arranged along the narrower sides of the electric heater element. The heating wires 1, the current-carrying wires 4 and lead wires 6 are connected by means of connection boxes 7.

Figure 3:
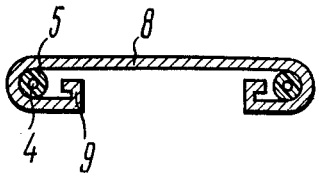
FIG. 3 is a transverse sectional view of jumper provided with projections for laying two current-carrying wires.
Figure 4:
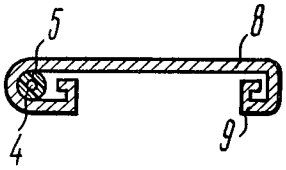
FIG. 4 is a transverse sectional view of a jumper provided with projections for laying one current-carrying wire.
Figure 5:
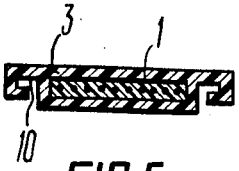
FIG. 5 is a cross-sectional view taken on line V-V in FIG. 1 of an electrically insulating base and a sealed sheathing with recesses for locking the jumpers in place.
Figure 6:
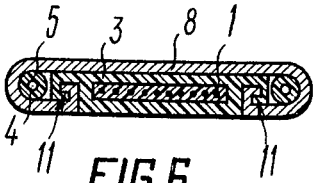
FIG. 6 is a cross-sectional view taken on line VI-VI in FIG. 2 of a flexible electric heater element with current-carrying wires and a jummper whose projections form a lock joint with recesses in the sealed sheathing.

The current-carrying wires 4 are locked in place by means of jumpers 8 (FIGS. 3 and 4) having projections 9 which form with recesses 10 (FIG. 5) in the sealed sheathing 3 of the electrically insulating base 2 a lock joint 11 (FIG. 6).

It should be pointed out that depending upon their purpose, flexible electric heater elements may have one current-carrying wire 4, as shown in FIG. 1, or current-carrying wires 4, as shown in FIG. 2. This accounts for different modifications of the jumpers 8 (FIGS. 3 and 4), depending upon the number of the current-carrying wires 4.

It should also be pointed out that the jumpers 8 and the sealed sheathing 3 of the electrically insulating base 2 may have recesses or grooves 10 and projections 9 of diverse configurations which, of course, correspond to each other to produce reliable lock joint 11. It should be borne in mind that the jumpers 8 are only found at the narrower upper and lateral sides of the sealed sheathing 3 of the electrically insulating base 2, which means that they do not produce any additional thermal resistance to the heat flux from the heating surface of the flexible electric heater element to an object being heated.

Figure 7:
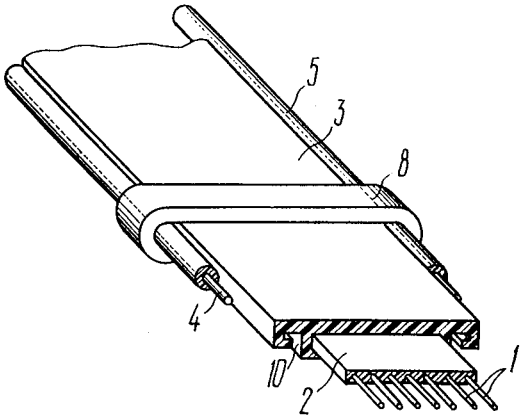
FIG. 7 is an axonometrical view of a flexible electring heater element.

An axonometrical view of the proposed flexible electric heater element with two current-carrying wires is shown in FIG. 7. In alternative embodiments, the jumper 8 may be continuous throughout the entire length of the electric heater element (not shown) or broken, as is shown in FIGS. 1, 2, 4, 6 and 7.

Figure 8:
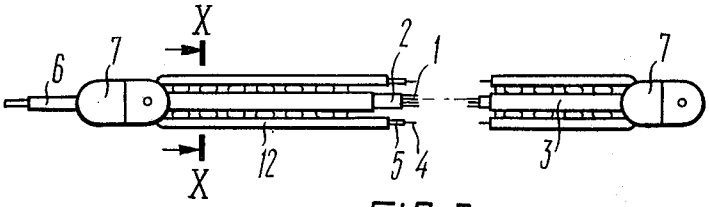
FIG. 8 is a general plan view of an alternative embodiment of a flexible electric heater element with two current-carrying wires arranged in lug channels of a sealed sheathing.

Another alternative embodiment of the present invention is shown in FIG. 8, wherein the heating wires 1 in the electrically insulating base 2 having the sealed sheathing 3, the current-carrying wires 4 in the coating 5, and the lead wires 6 are connected in suitable fashion, depending upon the connection diagram, by means of the connection boxes 7. The current-carrying wires 4 are locked in place with the aid of lugs 12 of the sealed sheathing 3 of the electrically insulating base 2 in closed channels 13 inside the lugs 12.

Figure 9:
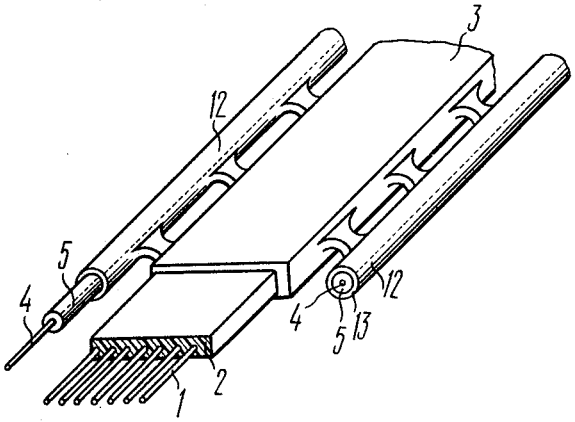
FIG. 9 is a partially axonometrical view of a flexible electric heater element with current-carrying wires disposed in channels provided in a sealed sheathing.
Figure 10:
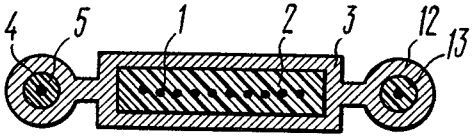
FIG. 10 is a cross-sectional view taken on line X-X in FIG. 8 of a flexible electric heater element with two current-carrying wires disposed in closed channels provided in lugs of a sealed sheathing.

The lugs 12 extend along the narrower sides of the heater element, throughot its length. An axonometric view of this structure of a flexible electric heater element is shown in FIG. 9; its cross-sectional view is shown in FIG. 10.

Figure 11:
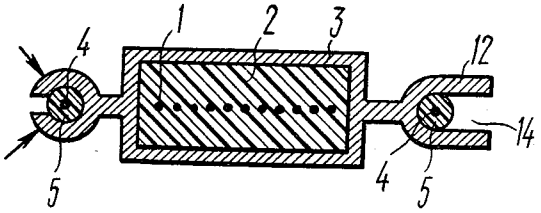
FIG. 11 is a similar sectional view of a flexible electric heater element with two current-carrying wires disposed in open channels provided in lugs of a sealed sheathing, one of said channels being closed (after being rolled)

Other alternative embodiments of the invention include a flexible electric heater element whose cross-sectional view is shown in FIG. 11. Unlike the previously discussed embodiments, the sealed sheathing 3 of the electrically insulating base 2 is made of a material having a residual plastic deformation, for example, aluminum, whereas the lugs 12 have open channels 13 which are rolled after the current-carrying wires 4 have been arranged in the coating 5, which makes it possible to produce a longitudinally cut cylindrical channel 13 with an open side 14 (FIG. 11).

In all the foregoing embodiments the axis of symmetry of the lugs 12 must correspond to the neutral axis of the electrically insulating base 2, i.e. of the whole element.

If it is necessary to warm up pipelines 300 to 350 m long, several heater elements are joined to one another. An example of joining electric heater elements and the design of a connection box are shown in FIG. 12.

Figure 12:
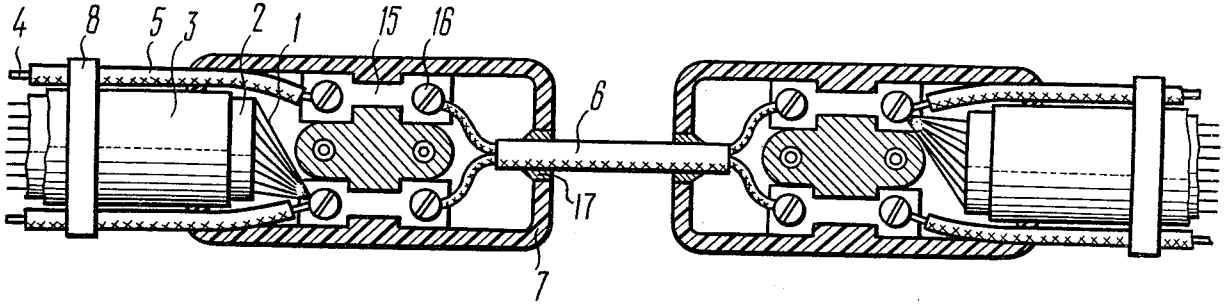
FIG. 12 is a sectional view of an assembly coupling two flexible electric heater elements by means of connection boxes.

FIG. 12 shows a connection of two electric heater elements into one circuit, wherein the heating wires 1 are connected with the aid of a terminal 15 to the current-carrying wires 4 and to the leads 6 with the aid of screws 16.

At the place where the lead 6 enters the connection box 7 there is installed a gasket 17.

As a flexible electric heater element is mounted on a pipeline to be warmed up, the beginning thereof is secured to the pipeline, after which, depending upon the specific uses of the heater element, it is wound at a preselected pitch around the pipeline to be heated or is arranged in a straight line along the pipeline. If the heater element is wound around a pipeline to be warmed up, its end is secured to the pipeline. If the heater element extends along the length of a pipeline to be heated, it is attached to the pipeline with the aid of a glass fabric band, the attachment points being spaced from one another at a distance of 0.4 to 0.6 m. If necessary, a second element is attached to the end of the first element, etc. In order to reduce heat losses due to release of heat into the surrounding medium, the object being heated and the electric heater element mounted thereon are thermally insulated. After this, protective metal casings are mounted above the thermally insulating layer (not shown). When the heater element is connected to a power source, heat is released from the heating wires and is transferred to the object to be warmed up.

What is claimed is:

1. A flexible electric heater element in the form of a band, comprising:

a plurality of heating wires;

an electrically insulating base in which said heating wires are embedded;

a sealed envelope enclosing said electrically insulating base, said envelope having opposite pairs of wide and narrow sides, at least one current-carrying wire extending outside said sealed envelope along a corresponding narrow side of said sealed envelope; and means securing said current-carrying wire to said sealed envelope.

2. A heater element as claimed in claim 1 wherein said means securing said current-carrying wire to said sealed envelope comprises a jumper supporting said current-carrying wire and interlock means on said sealed envelope and said jumper extending along said narrow sides.

3. A heater element as claimed in claim 1 wherein said means securing said current-carrying wire to said sealed envelope comprises a lug extending along the narrow side of the envelope at which the current-carrying wire is disposed, said lug having a groove in which said current-carrying wire is received.

4. A heater element as claimed in claim 3, wherein said lug is shaped as a split cylinder and is made of a material having a residual plastic deformation, said cylinder having a horizontal axis of symmetry coinciding with the neutral axis of said heater element.

5. A heater element as claimed in claim 4 wherein said lug is integral with said sealed envelope.

6. A heater element as claimed in claim 1 wherein said heating wires are adjacent one another in a row extending parallel to the wide sides of the envelope.

7. A heater element as claimed in claim 6 wherein said current-carrying wire is aligned with said row of heating wires.

* * * * *